US005097199A

United States Patent [19]

Casne

[11] Patent Number: 5,097,199

[45] Date of Patent: Mar. 17, 1992

[54] VOLTAGE CONTROLLED CURRENT SOURCE

[75] Inventor: Gregory M. Casne, Pittsburgh, Pa.

[73] Assignee: The United States of America as represented by the United States Department of Energy, Washington, D.C.

[21] Appl. No.: 632,675

[22] Filed: Dec. 21, 1990

[51] Int. Cl.[5] ..... G05F 1/56

[52] U.S. Cl. ..... 323/350; 323/351; 323/354

[58] Field of Search ..... 323/349, 350, 351, 268, 323/271, 282, 297, 353, 354

[56] References Cited

U.S. PATENT DOCUMENTS 4,145,649 3/1979 Pickton ..... 323/350
4,441,068 4/1984 Smith ..... 323/351
4,485,342 11/1984 Hill ..... 323/351

*Primary Examiner*—Peter S. Wong
*Attorney, Agent, or Firm*—William R. Moser; Judson R. Hightower; Richard E. Constant

[57] ABSTRACT

A seven decade, voltage controlled current source is described for use in testing intermediate range nuclear instruments that covers the entire test current range of from 10 picoamperes to 100 microamperes. High accuracy is obtained throughout the entire seven decades of output current with circuitry that includes a coordinated switching scheme responsive to the input signal from a hybrid computer to control the input voltage to an antilog amplifier, and to selectively connect a resistance to the antilog amplifier output to provide a continuous output current source as a function of a preset range of input voltage. An operator controlled switch provides current adjustment for operation in either a real-time simulation test mode or a time response test mode.

13 Claims, 6 Drawing Sheets

VOLTAGE CONTROLLED CURRENT SOURCE

FIELD OF THE INVENTION

This invention relates to voltage controlled current sources, and more specifically, to a voltage controlled current source for use in the testing of intermediate range nuclear instrument wherein the current source provides a continuous output current covering the entire seven decade span of the nuclear instrument from 10 picoamperes to 100 microamperes. Intermediate range nuclear instruments measure reactor power by receiving current from a compensated ion chamber detector.

BACKGROUND OF THE INVENTION

Testing of intermediate range nuclear instruments is conventionally conducted at a test facility with simulated current which represents reactor power. Intermediate range nuclear instruments tested in this way include, for example, the Weston S5W microelectronic (a discrete analog integrated circuit), the Westinghouse S6W microprocessor, and the Sorrento S6W microprocessor. During such testing, it has been found that an interface is required between the hybrid computer reactor simulation used in carrying out the test and the intermediate range nuclear instrument being tested.

It has been found that, ideally, the interface between the hybrid computer and the nuclear instrument would comprise a current source that receives as an input from the hybrid computer a voltage which represents the logarithm of core power, and produces as an output a real time, continuously variable current having a range of from 10 picoamperes to 100 microamperes. A real time current output is necessary in order for operational simulations to be performed, and a continuously variable current is required to avoid discontinuities in current which would otherwise invalidate the test results. Commercially available current sources do not satisfy the above criteria, especially in terms of providing a continuously variable current over a seven decade range.

SUMMARY OF THE INVENTION

In accordance with the invention, a current source is provided which satisfies the criteria set forth above, and thus provides a needed type of interface for carrying out successful testing of various intermediate range nuclear instruments. The voltage controlled current source of the invention is used as an interface between a hybrid computer and an intermediate range nuclear instrument, and receives as an input a differential voltage from the hybrid computer which varies from 1 to 8 volts and which represents the logarithm of core power. The current source produces an exponentially changing output current to the nuclear instrument as a function of the input voltage. The output current is in real time, is continuously variable and covers a range from 10 picoamperes to 100 microamperes.

The voltage controlled current source of the invention operates in two test modes, a time-response testing mode and a real-time simulation testing mode. The choice of the test mode is under operator control by means of a switch placed in an open or closed position. To explain, an intermediate range nuclear instrument generates its own bias current ($I_{bias}$) internally in the course of its operation. This bias current is needed for real-time simulation testing, but is not needed (and in fact would invalidate the test results) in time-response testing. Therefore, a two position switch is provided in the voltage controlled current source of the invention which enables the operator to select either time-response testing or real-time simulation testing.

As noted above, the nuclear instrument under test generates its own internal bias current within the instrument, and this internal bias current is added to the current received from the current source to produce the current inputted to the internal amplifiers of the nuclear instrument. In the time-response test mode, an amount of current equal to the internal bias current of the nuclear instrument is removed, i.e., subtracted, from the output current of the current source. On the other hand, in the real-time simulation test mode, the standard output current from the current source is delivered, in total, to the nuclear instrument, i.e., without any removal of current by the current source, and thus the nuclear instrument's own internal amplifiers receive the full current from the current source, to which is added the nuclear instrument's own internal bias current. As a result, a larger current is provided to the internal amplifiers of the nuclear instrument in the real-time simulation test mode than is provided in the time-response test mode. Based upon this difference in output current, each test mode of the current source has its own exponential transfer function associated with converting the input voltage to output current.

A central component of the current source is an antilog amplifier which provides an exponential conversion to an input voltage as part of the transfer function associated with each test mode. Controlled voltage inputs are provided to the antilog amplifier by means of comparator and switching circuits which respond to input signals from the hybrid computer. A continuous output current over a broad range is produced by means of a resistance switching circuit that is connected to the output of the antilog amplifier. The resistance switching is coordinated with the switching that controls the input voltage to the antilog amplifier. The broad continuous range of output current is thus made possible by the coordination of crossover points which occur, in an exemplary embodiment, at input voltage levels from the hybrid computer of 4 volts and 7 volts, to take place simultaneous with the switching in of a corresponding output resistance.

High precision in the output current is obtained throughout the entire seven decade range of the nuclear instrument through the provision of precision resistors in a three resistor switching scheme.

Thus, as should be apparent from the foregoing, a voltage controlled current source is provided for use as a testing interface between a hybrid computer and an intermediate range nuclear instrument wherein the operator can select operation in either a time-response test mode or a real-time simulation test mode. An exponential transfer function, according to the selected mode of operation, is applied by the current source interface to produce an output current continuous over a seven decade range corresponding, in an exemplary embodiment, to the 1 to 8 volt input received from the hybrid computer.

Other features and advantages of the present invention are set forth in, or will be apparent from, the following detailed description of preferred embodiments of the invention taken in conjunction with the accompanying drawings.

DETAILED DESCRIPTION OF THE PREFERRED EMBODIMENTS

Figure 1:
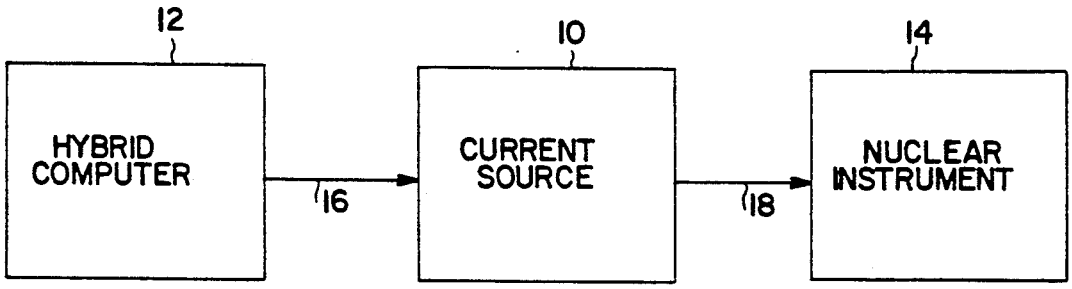
FIG. 1 is a block diagram showing the current source interfaced between a hybrid computer and a nuclear instrument under test.

FIG. 1 shows, in block diagram form, a voltage controlled current source 10 interfaced between the output of a hybrid computer 12 and the input to a nuclear instrument 14 under test. Current source 10 receives at an input 16 a linearly changing input voltage of from 1 to 8 volts from computer 12, and produces, at an output 18, a real time, continuously variable current that can vary from 10 picoamperes to 100 microamperes.

Figure 2:
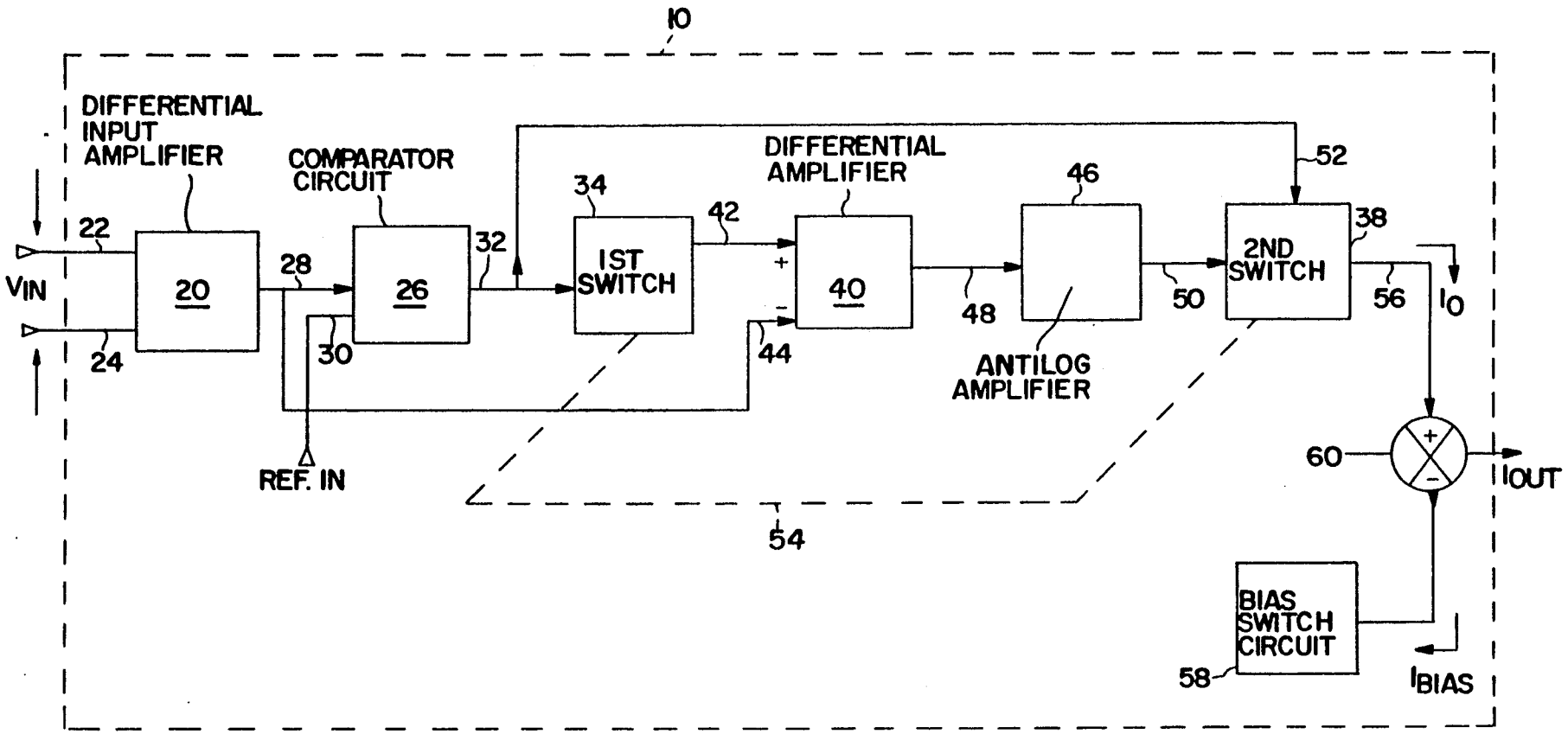
FIG. 2 is a block diagram of the voltage controlled current source according to the invention.

Details of current source 10 are shown in the block circuit diagram of FIG. 2. A differential input amplifier 20 receives from hybrid computer 12 of FIG. 1 a voltage at inputs 22 and 24. The output of differential input amplifier 20 is connected to comparator circuit 26 for comparing the signal received from differential input amplifier 20 at a first input 28 to a reference signal applied to a second input 30. It is noted that more than one reference input terminal can be used. Comparator 26, as explained below, comprises a plurality of logic circuits connected to the outputs of corresponding comparator circuits. The output signals produced by comparator 26 are delivered through output 32 to a first switch 34 and to a second switch 38.

First switch 34 and second switch 38 are activated responsive to signals produced at output terminal 32 of comparator 26. A differential amplifier 40 receives, at a positive input 42, the output of first switch 34 after the signal from that switch has passed through a buffer circuit (not shown in FIG. 2). The signal received at input 42 is compared with the output of differential input amplifier 20 which is inputted at a negative input 44 of differential amplifier 40. Differential amplifier 40 produces an output corresponding to the difference between the two signals received at inputs 42 and 44 and, in this way, serves to limit the amplitude of the input voltage received by an antilog amplifier 46 which is connected to the output of differential amplifier 40.

Antilog amplifier 46 performs an exponential conversion of an input voltage to an output voltage in accordance with the transfer function of the operating mode selected for the current source. A controlled voltage $E_{in}$ is delivered to input 48 of antilog amplifier 46, and is converted to a corresponding output voltage, at output 50, that varies exponentially with the input voltage $E_{in}$.

The second switch 38 is connected to the output of antilog amplifier 46 and, as explained below, comprises a plurality of switches for connecting a selected resistor from a plurality of resistors into the circuit. The switching is controlled by the output signal of comparator circuit 26 which is received at an input 52 of second switch 38.

Second switch 38 provides an output 56 connected to a summing junction 60. A bias switch circuit 58, described below, is also connected to summing junction 60. An output $I_{out}$ of summing junction 60 is the output current of the current source.

Direct signal connections used in controlling the switching of first switch 34 and second switch 38 are provided from the output 32 of comparator 26, and dotted line 54 in FIG. 2 is intended to indicate that the two switches 34 and 38 are coordinated to switch together in response to the output signal generated by comparator circuit 26, i.e., that a predetermined output signal from comparator 26 causes both switch 34 and switch 38 to respond together. The result is that first switch 34 causes a particular voltage input level to occur at input 48 of antilog amplifier 46 and, at the same time, second switch 38 connects a resistor of a selected value in the path of the output voltage of antilog amplifier 46, thereby providing a controlled current at the output of current source 10.

Figure 3:
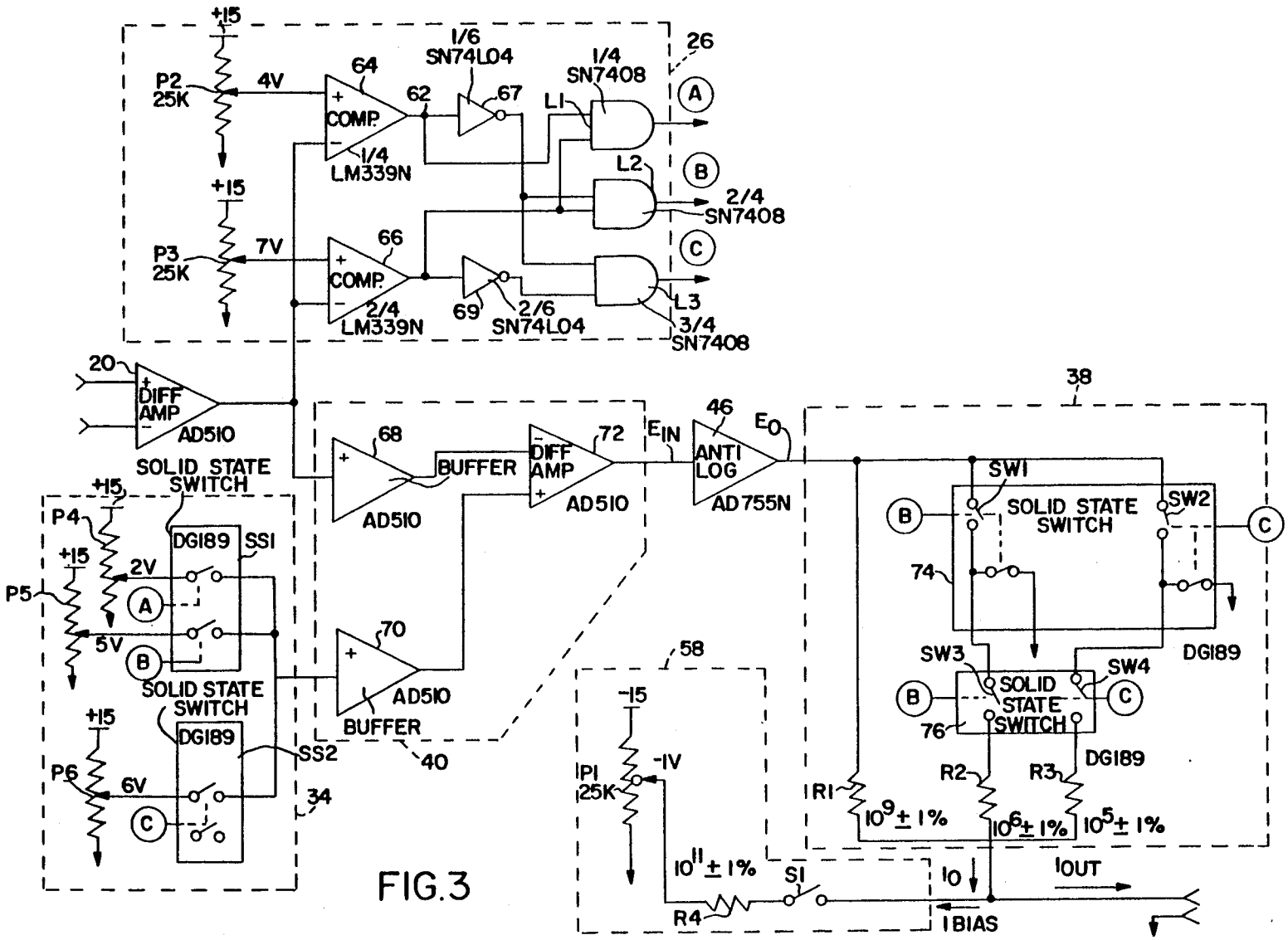
FIG. 3 is a schematic diagram of the voltage controlled current source.

Referring to FIG. 3, bias switch circuit 58 includes an adjustable potentiometer P1 connected to a negative voltage source for providing a predetermined bias current to be subtracted from the current, $I_o$, from switch 38 to thereby produce the current source output current, $I_{out}$, when a switch S1 of the bias switch circuit 58 is closed. Switch S1 comprises a two-position switch operable by the user in setting the controlled voltage current source in a real-time simulation test mode (switch S1 open), or in a time-response test mode (switch S1 closed).

In the time-response test mode, an amount of current equal to the internal bias current generated within the nuclear instrument under test is subtracted, at summing junction 60, from the second switch output current, $I_o$, to produce the output current $I_{out}$ of the current source. This serves to offset the internal bias current generated within the nuclear instrument. More specifically, by using a negative supply voltage connected to potentiometer P1 in bias circuit 58, and with switch S1 closed, the negative supply voltage causes an amount of current, equal to the internal bias current of the nuclear instrument, to be drawn away at junction 60 (FIG. 2), i.e., to be subtracted from the current outputted at 56 of second switch 38, and thus the current $I_{out}$ from the current source is equal to $I_o$ from second switch 38, less an amount of current equal to the bias current generated internally by the nuclear instrument, that is:

$$I_{out}=I_o-I_{bias} \quad \text{(1) (time response test mode)}$$

In the real-time simulation mode of operation, the switch S1 of bias switch means 58 is open, and there is thus no drawing away of current at junction 60; therefore, the output current $I_o$ from second switch 38 is delivered in total as the output current $I_{out}$ of the voltage control current source, that is:

$$I_{out}=I_o \quad \text{(2) (real-time simulation test mode)}$$

It is to this current $I_{out}$ of equation (2) that is added within the nuclear instrument a bias current needed in the real-time simulation test mode of operation.

Figure 4:
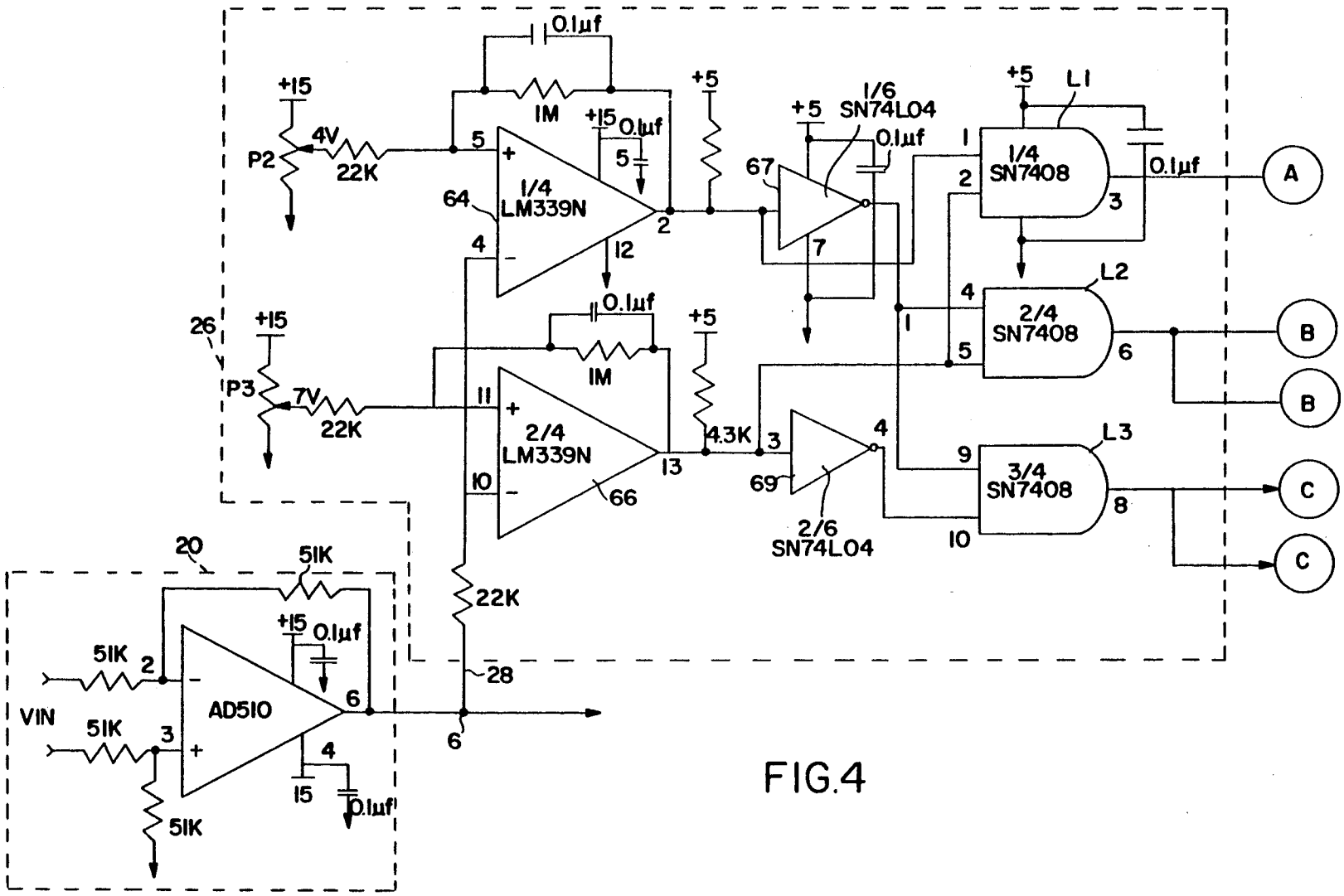
FIG. 4 is a detailed circuit schematic of the differential input amplifier and the comparator circuitry of the voltage controlled current source.
Figure 5:
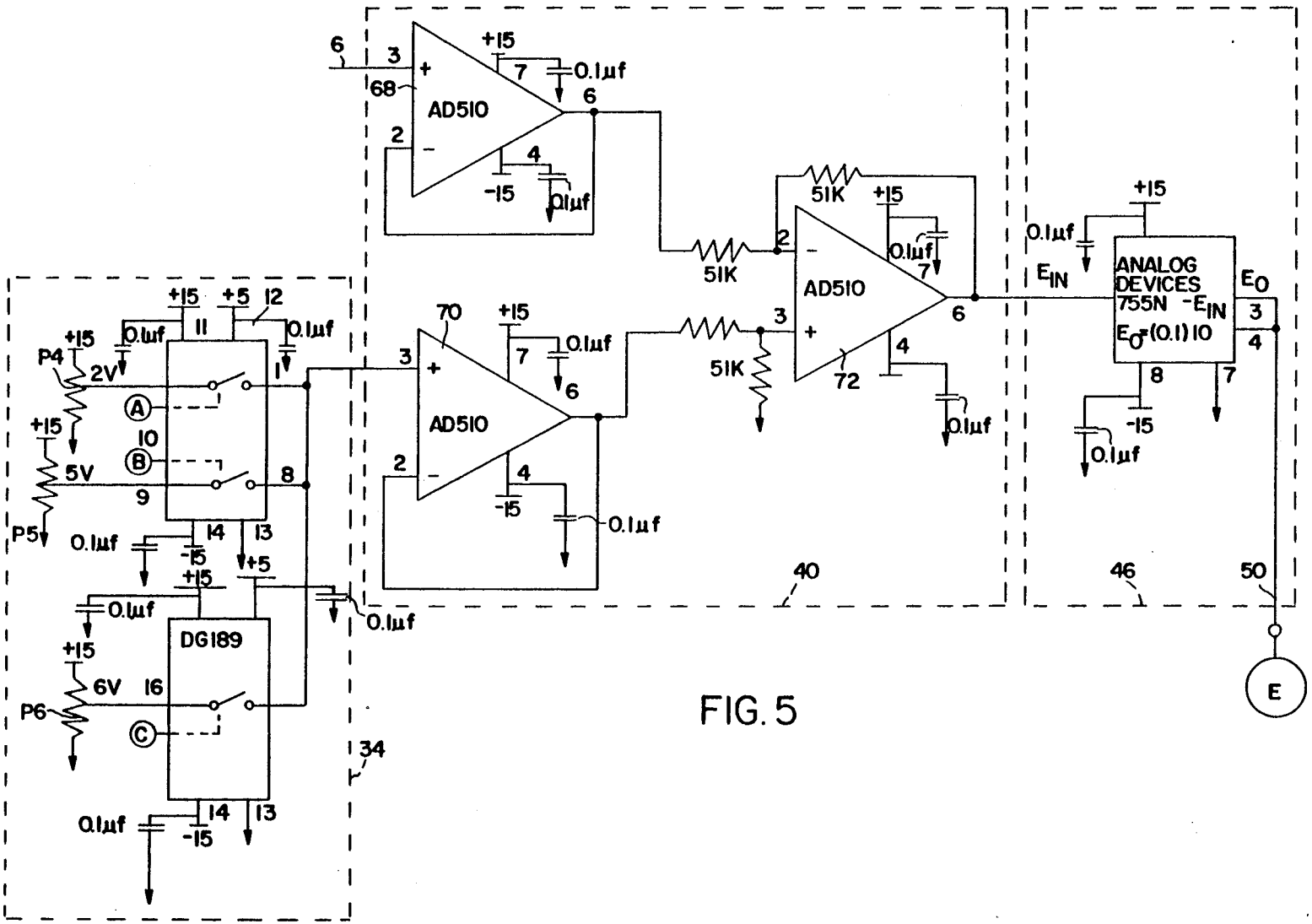
FIG. 5 is a detailed schematic of the first switch circuit, the differential amplifier and the antilog amplifier components of the voltage controlled current source.
Figure 6:
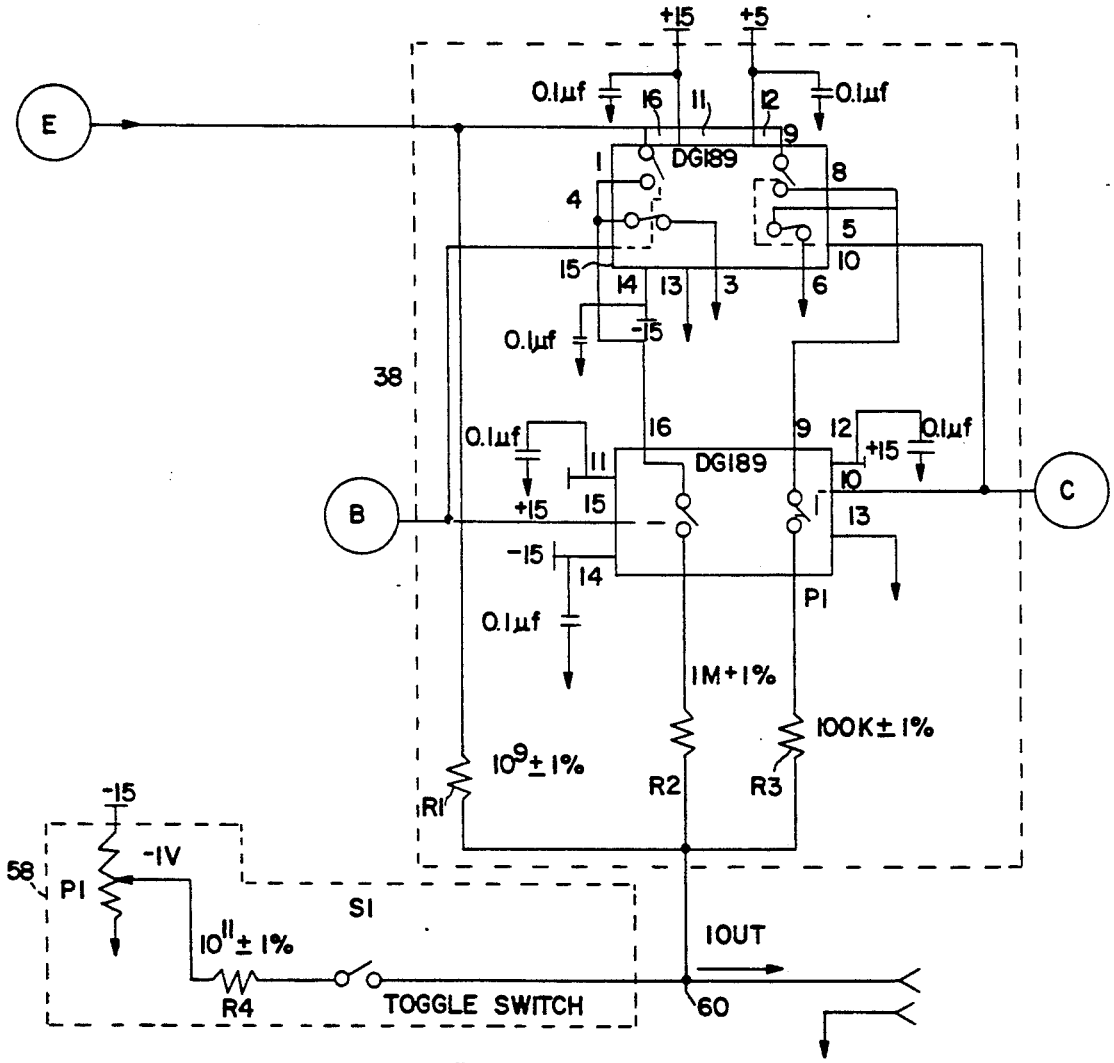
FIG. 6 is a detailed schematic of the second switch circuit and the bias switch circuit of the voltage controlled current source.

Further details of the individual circuit blocks of voltage control source 10 as shown in FIG. 2 are presented in FIG. 3, which shows the make-up and arrangement of the various circuits that make up a current source in accordance with a specific, exemplary embodiment of the invention. FIGS. 4 to 6 are even more detailed schematic circuit diagrams, showing such details as feedback and bias components added to the basic circuitry.

The further circuitry of the current source will next be described with reference to FIG. 3. Input differential amplifier 20 comprises, in this example, an AD 510 differential amplifier integrated circuit, as shown. Block 20 of FIG. 4 shows further details of the differential amplifier circuit 20 which are readily apparent from the drawing (e.g., the addition of specific bias and feedback resistors and capacitors), and thus will not be further described herein. As described above, the output of differential amplifier 20 is delivered to comparator 26, and is also delivered to an input buffer circuit of differential amplifier 40 as shown in FIG. 3.

Comparator 26, as shown in FIG. 3 (and in FIG. 4), uses a pair of comparator circuits 64 and 66 at its input, such as one quarter of the IM339N integrated circuit chip for each comparator circuit, as shown. Comparators 64, 66 each have positive and negative inputs, with the output of differential amplifier 20 being connected to the negative input of each comparator circuit, as shown. The signals to the positive inputs of the comparators are adjustable by means of a pair of potentiometers P2 and P3, each connected to a +15 VDC supply voltage. Additional circuit component details around comparators 64 and 66 are included in FIG. 4. The outputs of comparators 64 and 66 are inputted, respectively, to a first inverter 67 and a second inverter 69. Each inverter circuit comprises, in this example, one sixth of the SN74LO4 integrated circuit chip, as shown in FIG. 3 (and in FIG. 4). The output signals from comparators 64. 66 are also connected as inputs to logic circuits L1, L2 and L3, in the manner illustrated in FIG. 3. Logic circuits L1, L2 and L3 comprise, in this example, one fourth of an SN7408 integrated circuit chip, as shown. All resistors shown in FIG. 4 are ±5%, except the 51 Kohm resistors which are ±1%. The outputs from inverter 67 and inverter 69 are connected as inputs to logic circuits L2 and L3, as shown. Signals A, B or C outputted from logic circuits L1, L2 and L3 are used to activate the switch circuits, as discussed in more detail below.

As shown in FIG. 3, first switch 34 receives as inputs signals A, B and C, produced by the logic circuits L1, L2 and L3 of comparator 26. In particular, switch 34 comprises a pair of solid state switches SS1 and SS2, with the former receiving input signals A and B, and the latter receiving input signal C, as shown. The receiving signal activates the corresponding switch as indicated by the dotted lines associated with each signal. The switches SS1 and SS2 comprise, in this example, DG189 solid state switching circuits, as shown in FIG. 3, and may include the further associated circuitry shown in FIG. 5. Switch 34 also includes three potentiometers P4, P5 and P6 which are each connected to a +15 VDC supply, with each potentiometer wiper arm being adjustable to provide a preselected voltage to the switches controlled, respectively, by signals A, B and C. In this example, the preselected voltages provided for these switches are 2 volts, 5 volts and 6 volts, as indicated in FIG. 3, and one of these voltages constitutes the output of switch 34 depending on which activating signal, A, B or C, is received from comparator 26.

Differential amplifier unit 40 comprises a pair of buffer circuits 68 and 70, the output of each being connected to negative and positive inputs, respectively, of a differential amplifier circuit 72 within the overall differential amplifier block 40. Differential amplifier circuit 72, as well as buffer circuits 68 and 70, comprise, in this example, AD 510 integrated circuits, as shown in FIG. 3 (and in the more detailed circuit diagram of FIG. 5). The first buffer circuit 68 receives at its positive input the output signal from input differential amplifier 20. The input to the positive input terminal of the second buffer circuit 70 is the output signal from the first switch 34 which, as discussed above, is the voltage from one of the potentiometers P4, P5 or P6.

The antilog amplifier 46, which is connected to receive an input voltage $E_{in}$ from differential amplifier 40, comprises, in this example, an AD 755N integrated circuit, as shown in FIG. 3 (and in FIG. 5). An output voltage $E_o$ is produced at the output of antilog amplifier 46 according to the following equation:

$$E_o=(0.1)10^{-E_{in}} \quad (3)$$

Thus, antilog amplifier 46 produces an exponential voltage output which is a function of a linear voltage input.

As shown in FIG. 3 (and in more detail in FIG. 6) second switch 38, in the preferred embodiment being considered, comprises a pair of switching circuits 74 and 76. Each switching circuit, 74, 76, comprises a DG189 integrated circuit, each circuit containing two single pole; double throw switches SW1, SW2, and SW3, SW4, respectively, and control of the switching operations thereof is dependent upon receipt of either signal B or signal C from comparator 26. More specifically, upon receipt of signal B, the switches SW1 and SW3 are activated while, upon receipt of signal C, the switches SW2 and SW4 are activated. If neither signal B nor C is received, then the output signal from antilog circuit 46 is connected through a $10^9$ ohm (1 Gohm) resistor R1 so as to determine the output current, $I_{out}$. On the other hand, if signal B is received, the $10^9$ ohm resistor R1 is connected in parallel with a 1 megohm resistor R2, whereas upon receipt of signal C, the $10^9$ ohm resistor R1 is connected in parallel with a 100 Kohm resistor R3, as shown in FIGS. 3 and 6. Thus, the output resistance of second switch 38 varies depending upon the output signal received from the logic circuitry of comparator 26 which, in turn, is dependent upon the value of voltage $V_{in}$ at the output of input differential amplifier 20.

At the same time that signal B, for example, is received by second switch 38, signal B is also received at first switch 34 so to produce, in the example shown in FIGS. 3 and 5, a 5 volt DC voltage at the input of buffer amplifier 70. Similarly, if signal C is inputted to second switch 38, that same signal is also received by first switch 34 and produces, in the example shown, a 6 volt DC voltage at the input of buffer amplifier 70. Thus, it is seen that the voltage, $E_{in}$, inputted to antilog amplifier 46 is related to the value of output resistance of second switch 38 and the two determine the controlled output current, $I_{out}$.

As described above and as shown in FIG. 3 (and in FIG. 6), bias switch circuit 58 comprises a potentiometer P1 having a negative 15 VDC supply voltage, with the wiper arm of potentiometer P1 adjusted to produce a minus 1 VDC at the wiper arm output. This wiper arm is connected through resister R4 to switch S1. As discussed above, when voltage controlled current source 10 is operated in the real time simulation test mode described, the bias current generated within the nuclear instrument under test is needed for proper testing, so within the current source, no current is substrated from the current outputted from second switch 38. Therefore, switch S1 is set to an open circuit position and the entire current $I_o$ outputted from second switch 38 is delivered through summing junction 60, as the current out, $I_{out}$, of the current source to the nuclear instrument. This is in accordance with equation (2), above.

On the other hand, when the voltage controlled current source is operated in the time response test mode, an adjustment in the output current of the voltage controlled current source is necessary to offset the internal bias current generated within the nuclear instrument. Accordingly, in the time response test mode, switch S1 is closed so that the negative voltage draws a preset amount of current, set by the combination of resistor R4 and potentiometer P1 to be equal to the bias current generated within the nuclear instrument, from the output current $I_o$ from second switch 38, such that the output current of the current source, $I_{out}$, has an amount of current substracted from $I_o$ at junction 60, according to equation (1), above.

B and C inputs are not activated in second switch 38, resistors R2 and R3 of switch 38 are open circuited and an output resistance of 1 gigaohm ($10^9$ ohm) corresponding to the resistance of resistor R1 is provided within second switch 38.

Similarly, when $V_{in}$ is greater than 4 volts but less than 7 volts, signal B from comparator 26 is HIGH, and signals A and C are LOW. This results in selection of the nominal 5 volt signal from potentiometer P5 within first switch 34, and an output resistance of 1 megohm in parallel with 1 gigaohm (provided by resistors R1 and R2) within second switch 38. Likewise, when $V_{in}$ is greater than 7 volts, signal C from comparator 26 is HIGH, and signals A and B are LOW. This results in selection of the nominal 6 volt signal from potentiometer P6 in first switch 34, and an output resistance of 100 Kohms in parallel with 1 gigaohm (provided by resistors R1 and R3) within second switch 38.

This "voltage substitution" provided by first switch 34 causes differential amplifier 40 (FIG. 3) to compare input signal $V_{in}$ over the entire 1 to 8 volt range with an input voltage from first switch 34 such that the difference outputted, $E_{in}$, is held to a controlled level consistent with proper operation of antilog amplifier 46. Thus, by proper adjustments, particularly of potentiometers P2 and P3, an output current with smooth transitions, i.e., with no discontinuities, is realized over the 1 to 8 volt input range of the voltage received from the hybrid computer.

This operation is summarized in the following Table I.

TABLE I

| Hybrid Computer Voltage ($V_{in}$) | Voltage in to Antilog Amplifier ($E_{in}$) | Voltage out from Antilog Amplifier ($E_{out}$) | Output Resistance | *Output Current |
|---|---|---|---|---|
| 1 volts | 1 volt | 10 millivolts | 1G | 10 picoamperes |
| 2 volts | 0 | 100 millivolts | 1G | 100 picoamperes |
| 3 volts | −1 | 1 volt | 1G | 1 nanoampere |
| 4 volts | −2/1 | 10 volts/ 10 millivolts | 1G/1M | 10 nanoamperes |
| 5 volts | 0 | 100 millivolts | 1M | 100 nanoamperes |
| 6 volts | −1 | 1 volt | 1M | 1 microampere |
| 7 volts | −2/−1 | 10 volts/1 volt | 1M/100K | 10 microamperes |
| 8 volts | −2 | 10 volts | 100K | 100 microamperes |

Turning now to a typical operation of the current source, an input signal, $V_{in}$, is received from a hybrid computer as input to the voltage controlled current source at input terminals 22, 24 (FIG. 2). In the exemplary embodiment under consideration, the $V_{in}$ signal appears at the output of differential input amplifier 20, and is delivered to comparator 26, and, more specifically referring to FIG. 3, to the negative inputs of comparator circuits 64 and 66, respectively. When $V_{in}$ is less than 4 volts, and with a preset reference voltage level at the positive input of comparator circuit 64 set at 4 volts and the reference level at the positive input of comparator circuit 66 set for 7 volts (as shown in FIG. 3), the input voltage received by each comparator remains below the preset references, and both comparator circuit outputs, which are delivered to inverters 67 and 69, are HIGH. This produces a HIGH output signal A, and LOW output signals B and C at the outputs of comparator 26. These output signals are inputted to first switch 34 and second switch 38 at the input points as indicated by the alphabet references in FIG. 3. This results in activation of the switch associated with the 2 volt signal from potentiometer P4 of first switch 34 and, since the It will be appreciated that the "Output Current" of Table I is $I_{out}$ of the voltage controlled current source in the real-time simulation test mode, i.e., with switch S1 open. Thus $I_{out}=I_o$, as no current equal to the nuclear instrument's own bias current is removed at junction 60 from the output current $I_o$ of second switch 38. The first column of Table I represents the range of input voltage to voltage controlled current source 10. The second column represents the voltage $E_{in}$ at the input terminal of antilog amplifier 46; the voltage $E_{in}$ results from the action of comparator 26, first switch 34 and differential amplifier 40, as discussed above. The fourth column indicates the output resistance provided by second switch 38 for each level of input voltage $V_{in}$, also as was discussed.

From the data of Table I, it is noted that the voltage input $E_{in}$ to antilog amplifier 46, and the output resistance provided by second switch 38, change abruptly at input voltage levels of 4 and 7 volts. This is due to the switching provided by the A, B and C signals from comparator 26. Highly accurate output currents are achieved by using antilog amplifier output voltages, $E_{out}$, of relatively large magnitudes, i.e., greater than 10 millivolts, in comparison with circuit noise as measured across the output resistance of second switch 38.

The steady state accuracy of voltage controlled current source 10 according to the invention was tested by inputting a constant voltage, and measuring the output current with a Keithley picoameter (Model 410). The results of the test showed that high accuracy was obtained, with a maximum error of only 1.43%. Both full scale operational simulations and time response testing were also performed successfully.

Although the present invention has been described relative to exemplary embodiments thereof, it will be understood by those skilled in the art that variations and modifications can be effected in these exemplary embodiments without departing from the scope and spirit of the invention.

I claim:

1. A voltage controlled current source for providing a continuous output current for the testing of an intermediate range nuclear instrument in a testing system comprising a computer for producing an input voltage which varies over a predetermined range, said current source comprising:

(a) comparing means for receiving an input signal from said computer, for comparing said input signal to at least one preset reference level, and for selectively providing an output signal in accordance with the results of the comparison;

(b) first switch means for receiving said output signal and for selectively producing an output reference voltage;

(c) second switch means for simultaneously receiving said output signal and for selectively providing an output resistance in accordance therewith;

(d) differential amplifier means for receiving said output reference and said input signal and providing a differential voltage signal;

(e) antilog amplifier means for receiving said differential voltage signal and providing an exponentially varying output voltage to the output resistance as a function of said differential voltage signal to produce the continuous output current.

2. A current source according to claim 1, wherein said current source comprises summing means for receiving a current from said output resistance, and bias switch means attached to said summing means for selectively subtracting a preset amount of current from the current to produce the continuous output current.

3. A current source according to claim 2, wherein said bias switch means comprises a potentiometer connected to a power supply with a potentiometer wiper arm connected in series with a switch attached to said summing means for selectively connecting said bias switch means to said summing means when the switch is in a closed position.

4. A current source according to claim 3, wherein the predetermined amount of current received by the bias switch means when said switch is in said closed position is equal to a bias current generated internally by the intermediate range nuclear instrument.

5. A current source according to claim 1, wherein said input signal is received by at least one comparator circuit, and said preset reference level is provided by at least one user-adjustable potentiometer connected to a supply voltage.

6. A current source according to claim 5, wherein the comparing means comprises invertor means for receiving an output of the at least one comparator circuit and producing at least one invertor output signal, and logic means for receiving the at least one invertor output signal and producing said output signals comprising a plurality of logic output signals.

7. A current source according to claim 6, wherein said first switch means comprises a plurality of inputs for receiving said plurality of logic output signals, and for activating at least one switch within said first switch means in accordance with the received logic output signals.

8. A current source according to claim 7, wherein said first switch means comprises at least one user-adjustable potentiometer connected to a power supply for selectively providing the output reference voltage as a function of the plurality of logic output signals.

9. A current source according to claim 1, wherein said differential amplifier means comprises buffer means for receiving said input signal and said reference voltage, and for producing buffer signal outputs to a differential amplifier circuit for providing said differential voltage signal of a limited, predetermined voltage range.

10. A current source according to claim 1, wherein said second switch means comprises:

(a) a first resistor;

(b) a second resistor connected in series with a first switch, at least one second resistor switch responsive to output signals of the comparing means; and (c) a third resistor connected in series with a further switch responsive to output signals of the comparing means;

the first resistor and the third resistor being connected in parallel between an input and an output of said second switch means.

11. A current source according to claim 10, wherein the first switch and the third switch are contained within a single, solid state switch circuit comprising two single-pole double-throw switches.

12. A current source according to claim 9, wherein the second switch and the fourth switch are contained within a single, solid state switch circuit comprising two single-pole double-throw switches.

13. A voltage controlled current source for providing a continuous and variable output current in response to a preset range of input voltages, said current source comprising signal generation means for receiving said input voltages and producing an output control signal in accordance therewith, switch means for receiving said output signal and selectively producing a differential output voltage and a corresponding output resistance, and antilog amplifier means for receiving said differential output voltage and producing an exponentially varying antilog output voltage, which is applied to said output resistance to produce said output current.

* * * * *